US008215147B2

(12) United States Patent
Horton et al.

(10) Patent No.: US 8,215,147 B2
(45) Date of Patent: Jul. 10, 2012

(54) HOT STAMPING DIE APPARATUS

(75) Inventors: Frank A. Horton, Rochester Hills, MI (US); Boris Shulkin, West Bloomfield, MI (US); Bradford L. Hastilow, Rochester Hills, MI (US); Jim Metz, Chicago, IL (US); James R. Judkins, Leonard, MI (US); Monty Hansen, Sterling Heights, MI (US); Seetarama S. Kotagiri, Rochester Hills, MI (US); Andreas G. Janssen, Troy, MI (US)

(73) Assignee: Magna International Inc., Aurora, Ontario (CA)

( * ) Notice: Subject to any disclaimer, the term of this patent is extended or adjusted under 35 U.S.C. 154(b) by 691 days.

(21) Appl. No.: 12/373,904

(22) PCT Filed: Jul. 12, 2007

(86) PCT No.: PCT/CA2007/001223

§ 371 (c)(1),
(2), (4) Date: Jan. 15, 2009

(87) PCT Pub. No.: WO2008/009101

PCT Pub. Date: Jan. 24, 2008

(65) Prior Publication Data

US 2009/0320547 A1 Dec. 31, 2009

(51) Int. Cl.

| | |
|---|---|
| ***B21D 37/16*** | (2006.01) |
| ***B21K 5/20*** | (2006.01) |
| ***C21D 1/00*** | (2006.01) |

(52) U.S. Cl. ..... 72/342.3; 72/463; 72/469; 76/107.1; 148/654; 148/661

(58) Field of Classification Search ..... 72/342.1, 72/342.2, 342.3, 462, 463, 469, 476; 148/637, 148/638, 647, 654, 660, 661; 76/107.1
See application file for complete search history.

(56) References Cited

U.S. PATENT DOCUMENTS

| | | | | |
|---|---|---|---|---|
| 5,079,974 | A * | 1/1992 | Weiss et al. | 76/107.1 |
| 6,279,425 | B1 * | 8/2001 | Cicotte | 76/107.1 |
| 6,328,829 | B1 * | 12/2001 | Kato et al. | 148/647 |
| 6,598,450 | B2 | 7/2003 | Blue | |
| 6,598,451 | B2 | 7/2003 | Blue | |
| 6,742,374 | B2 * | 6/2004 | Ozawa | 72/342.5 |
| 2004/0128016 | A1 * | 7/2004 | Stewart | 700/159 |
| 2006/0138698 | A1 | 6/2006 | Chapuis | |

FOREIGN PATENT DOCUMENTS

| | | | |
|---|---|---|---|
| JP | 04-307207 | A | 10/1992 |
| WO | 97/16274 | A1 | 9/1997 |
| WO | 01/36128 | A1 | 5/2001 |
| WO | 01/70450 | A1 | 9/2001 |
| WO | 2004/024359 | A2 | 3/2004 |

* cited by examiner

*Primary Examiner* — Kevin P Kerns
(74) *Attorney, Agent, or Firm* — Dickinson Wright PLLC

(57) ABSTRACT

A hot forming die that includes a first die and a second die. The first die has a first die structure that is formed of a tool steel. The first die structure has a first die surface and a plurality of first cooling apertures. The first die surface has a complex shape. The first cooling apertures are spaced apart from the die surface by a first predetermined distance. The second die has a second die surface. The first and second die surfaces cooperate to form a die cavity. Related methods for forming a hot forming die and for hot forming a workpiece are also provided.

13 Claims, 9 Drawing Sheets

HOT STAMPING DIE APPARATUS

INTRODUCTION

The present disclosure generally relates to hot forming dies and more particularly to a hot forming die and methods for its manufacture and use.

Vehicle manufacturers strive to provide vehicles that are increasingly stronger, lighter and less costly. For example, vehicle manufacturers have expended significant efforts to utilize non-traditional materials, such as sheet aluminum, advanced high strength steels, and ultra-high strength steels, for portions of the vehicle body. While such materials can be both relatively strong and light, they are typically costly to purchase, form and/or assemble.

One proposed solution includes the use of heat-treated sheet steel panel members to form the vehicle body. In some applications, the sheet steel panel members are formed in a conventional forming process and subsequently undergo a heat-treating operation. This two-stage processing is disadvantageous in that the additional operation adds significant cost and the components can distort during the heat treat operation.

As an alternative to a process that employs a discrete heat-treating operation, it is known that certain materials, such as boron steels, can be simultaneously formed and quenched in a hot forming die. In this regard, a pre-heated sheet stock is typically introduced into a hot forming die, formed to a desired shape and quenched subsequent to the forming operation while in the die to thereby produce a heat treated component.

The known hot forming dies for performing the simultaneous hot forming and quenching steps typically employ water cooling passages (for circulating cooling water through the hot forming die) that are formed in a conventional manner, such a gun drilling. As those of ordinary skill in the art will appreciate, the holes produced by techniques such as gun drilling yield straight holes that extend through the dies. Those of ordinary skill in the art will also appreciate that as vehicle manufacturers typically do not design vehicle bodies with components that are flat and straight, the forming surfaces or die surfaces of the hot forming die will typically not be flat and planar. As such, it would not be possible for drilled water cooling passages to conform to the contour of a die surface of a hot forming die for a typical automotive vehicle body component. This fact is significant because a hot forming die that has a three-dimensionally complex shape but employs conventionally constructed water cooling passages can have portions that are hotter than desired so that the quenching operation will not be performed properly over the entire surface of the vehicle body component. As such, components formed by the known hot forming dies can have one or more regions that are relatively softer than the remainder of the component.

Accordingly, there remains a need in the art for an improved hot forming die.

SUMMARY

In one form the present teachings provide a method that includes: providing a first die having a first die structure primarily formed of a tool steel; forming a first die surface on the first die structure, the first die surface having a complex shape; forming a plurality of cooling channels in the first die structure, each of the cooling channels having a contour that generally follows the complex shape of the first die surface; and forming a second die with a second die surface, the first and second die surfaces cooperating to form a die cavity.

In another form, the present teachings provide a hot forming die that includes a first die and a second die. The first die has a first die structure that is formed of a tool steel. The first die structure has a first die surface and a plurality of first cooling apertures. The first die surface has a complex shape. The first cooling apertures are spaced apart from the die surface by a first predetermined distance. The second die has a second die surface. The first and second die surfaces cooperating to form a die cavity.

In yet another form the present teachings provide a method of hot forming a workpiece that includes: providing a die with an upper die and a lower die, each of the upper and lower dies including a die structure that defines a die surface and a plurality of cooling channels, the die surface having a complex shape, the cooling channels being spaced apart from the die surface in a manner that generally matches a contour of the die surface, the die surfaces cooperating to form a die cavity; heating a steel sheet blank; placing the heated steel sheet blank between the upper and lower dies; closing the upper and lower dies to form the workpiece in the cavity; cooling the die structures of the upper and lower dies to quench the workpiece in the cavity; and ejecting the quenched workpiece from the cavity.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
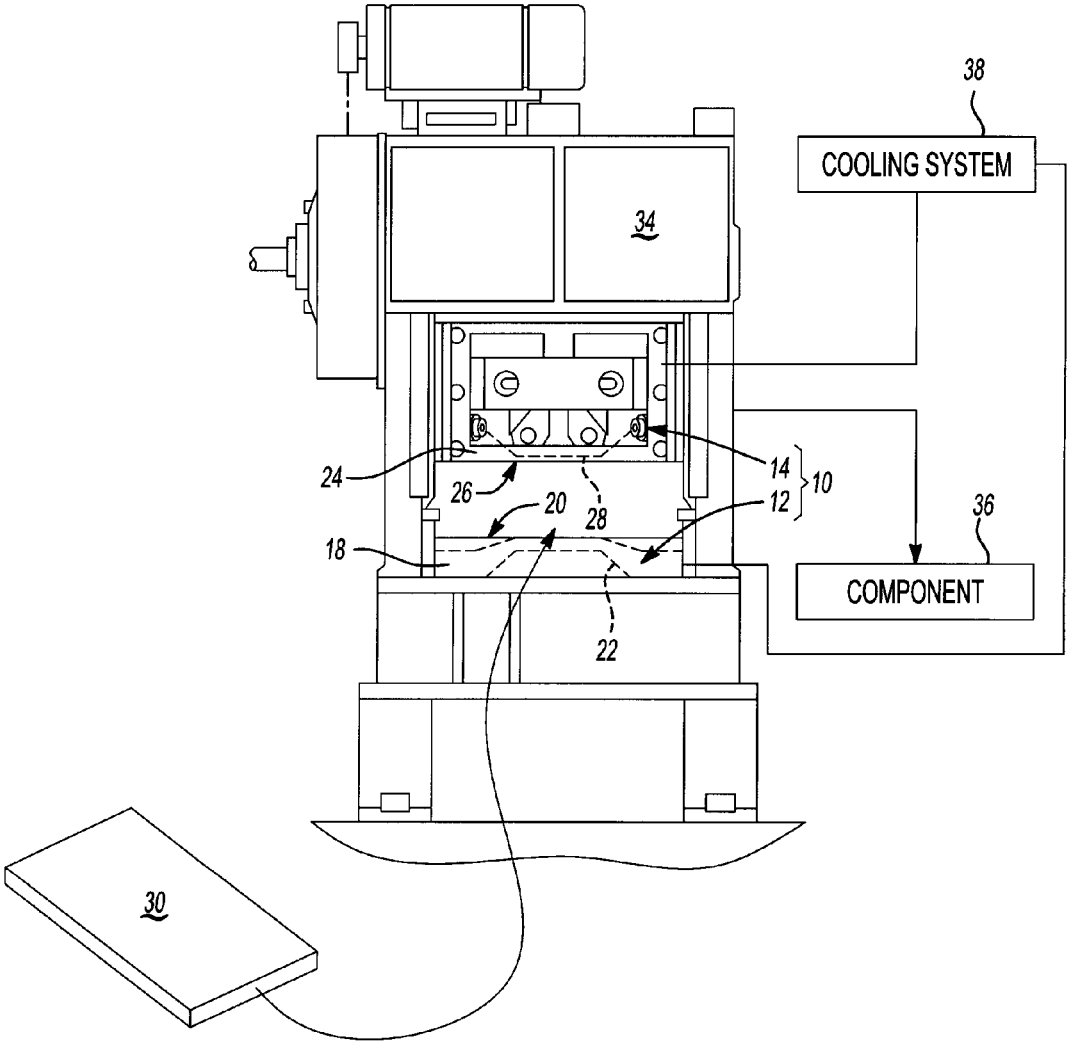
FIG. 1 is a schematic illustration of a hot forming die set constructed in accordance with the teachings of the present disclosure, the hot forming die set being mounted in a stamping press and coupled to a source of cooling fluid.

With reference to FIG. 1 of the drawings, a hot forming die set 10 constructed in accordance with the teachings of the present invention is schematically illustrated. The hot forming die set 10 can include a lower die 12 and an upper die 14. The lower die 12 can include a die member 18 that can be formed of a heat conducting material such as tool steel, in particular DIEVAR®, which is marketed by Böhler-Uddeholm Corporation of Rolling Meadows, Ill., or commercially available H-11 or H-13. The die member 18 can include a complex forming or die surface 20 and a plurality of cooling channels 22. As used herein, the term "die surface" refers to the portion of the exterior surface of a die that forms a hot formed component. Moreover, the term "complex die surface" as used in this description and the appended claims means that the die surface has a three-dimensionally contoured shape that is not conducive for reliably facilitating an austenite-to-martensite phase transformation in volume production (i.e., a rate of 30 workpieces per hour or greater) if the die surface were to be cooled via cooling channels that are formed by gun drilling the cooling channel through one or two sides of the die. Each cooling channel 22 can be offset from the complex die surface 20 by a first predetermined distance and this distance can be consistent along the length of the cooling channel 22. Similarly, the upper die 14 can include a die member 24 that can be formed of a tool steel, such as DIEVAR® or commercially available H-11 or H-13, and can include a complex die surface 26 and a plurality of cooling channels 28. Each cooling channel 28 can be offset from the complex die surface 26 by a second predetermined distance, which can be different from the first predetermined distance, and this distance can be consistent along the length of the cooling channel 28. The complex die surfaces 20 and 26 can cooperate to form a die cavity therebetween.

A blank 30, which can be formed of an appropriate heat-treatable steel, such as boron steel, can be pre-heated to a predetermined temperature, such as about 930° C., and can be placed in the die cavity between the complex die surfaces 20 and 26. The lower and upper dies 12 and 14 can be brought together (i.e., closed) in a die action direction via a conventional stamping press 34 to deform the blank 30 so as to form and optionally trim a hot-stamped component 36. Cooling fluid, such as water, gas or other fluid medium, which can be provided by a cooling system 38 (e.g., a cooling system that conventionally includes a reservoir/chiller and a fluid pump) can be continuously circulated through the cooling channels 22 and 28 to cool the lower and upper dies 12 and 14, respectively. It will be appreciated that the circulating cooling fluids will cool the lower and upper dies 12 and 14 and that the lower and upper dies 12 and 14 will quench and cool the hot-stamped component 36. The stamping press 34 can maintain the lower and upper dies 12 and 14 in a closed relationship for a predetermined amount of time to permit the hot-stamped component 36 to be cooled to a desired temperature.

The distance between the cooling channels 22 and 28 and the complex die surfaces 20 and 26, respectively, as well as the mass flow rate of the cooling fluid and the temperature of the fluid are selected to control the cooling of both the lower and upper dies 12 and 14 such that the hot-stamped component 36 is quenched in a controlled manner consistently across its major surfaces to cause a phase transformation to a desired metallurgical state. In the particular example provided, the blank 30 is heated such that its structure is substantially (if not entirely) composed of austenite, the heated blank 30 is formed between the lower and upper dies 12 and 14 and the hot-stamped component 36 is quenched by the lower and upper dies 12 and 14 prior to the ejection of the hot-stamped component 36 from the lower and upper dies 12 and 14. In this regard, the lower and upper dies 12 and 14 function as a heat sink to draw heat from and thereby quench the hot-stamped component 36 in a controlled manner to cause a desired phase transformation (e.g., to martensite or bainite) in the hot-stamped component 36 and optionally to cool the hot-stamped component 36 to a desired temperature. Thereafter, the lower and upper dies 12 and 14 can be separated from one another (i.e., opened) and the heat-treated hot-stamped component 36 can be removed from the die cavity. Construction of the hot forming die set 10 in accordance with the teachings of the present disclosure permits the rate of quenching at each point on the die surface to be controlled in a precise manner. This is particularly advantageous for high-volume production as it is possible to employ relatively short overall cycle times while achieving an austenite-to-martensite transformation. In our experiments and simulations, we have found that it is possible to obtain an austenite-to-martensite transformation within about 5 seconds from the closing of the hot forming die set 10 and that in some situations it is possible to obtain an austenite-to-martensite transformation within about 2 to about 4 seconds from the closing of the hot forming die set 10.

Figure 2:
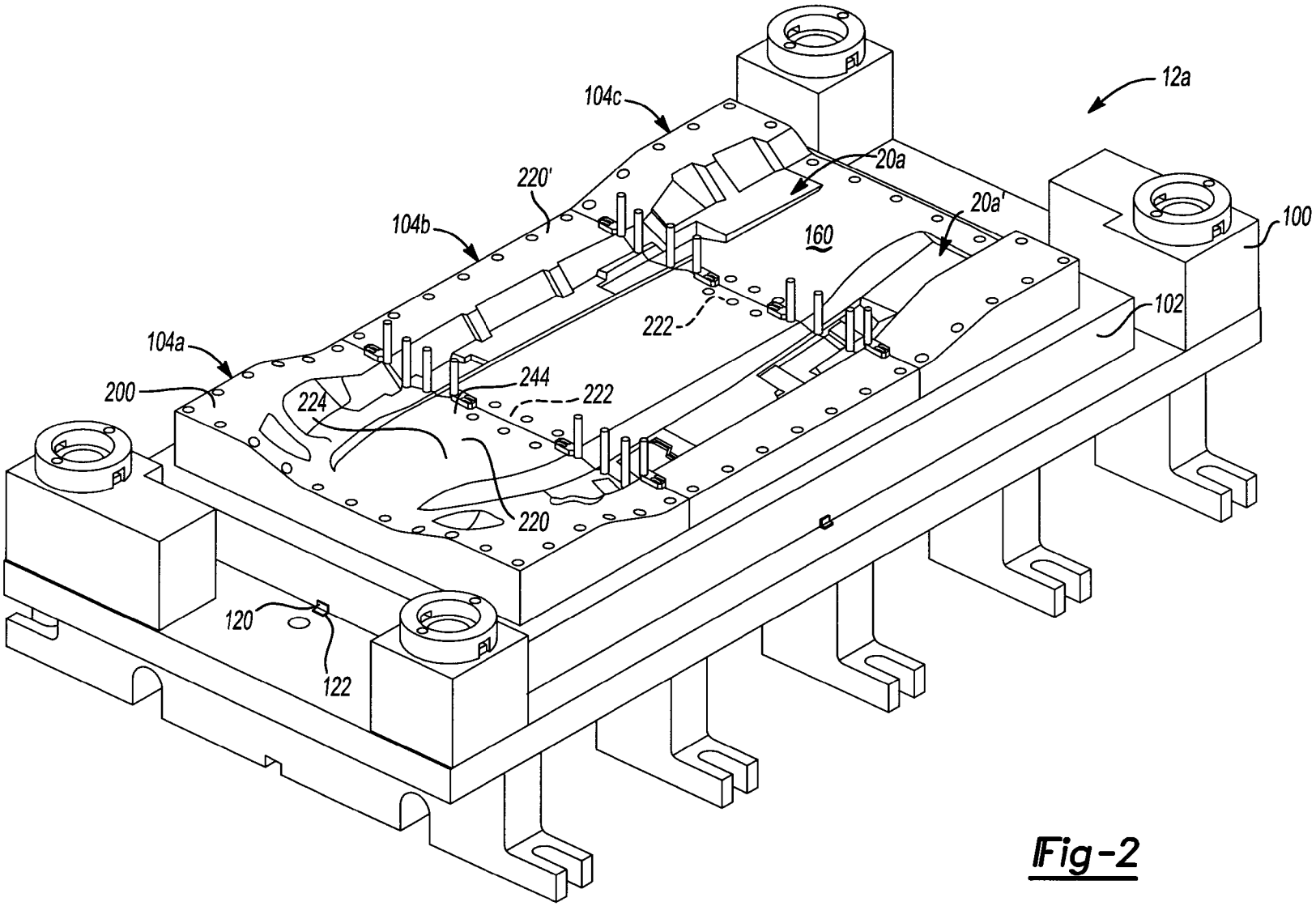
FIG. 2 is a perspective view of a lower die of a first exemplary hot forming die set constructed in accordance with the teachings of the present disclosure.
Figure 3:
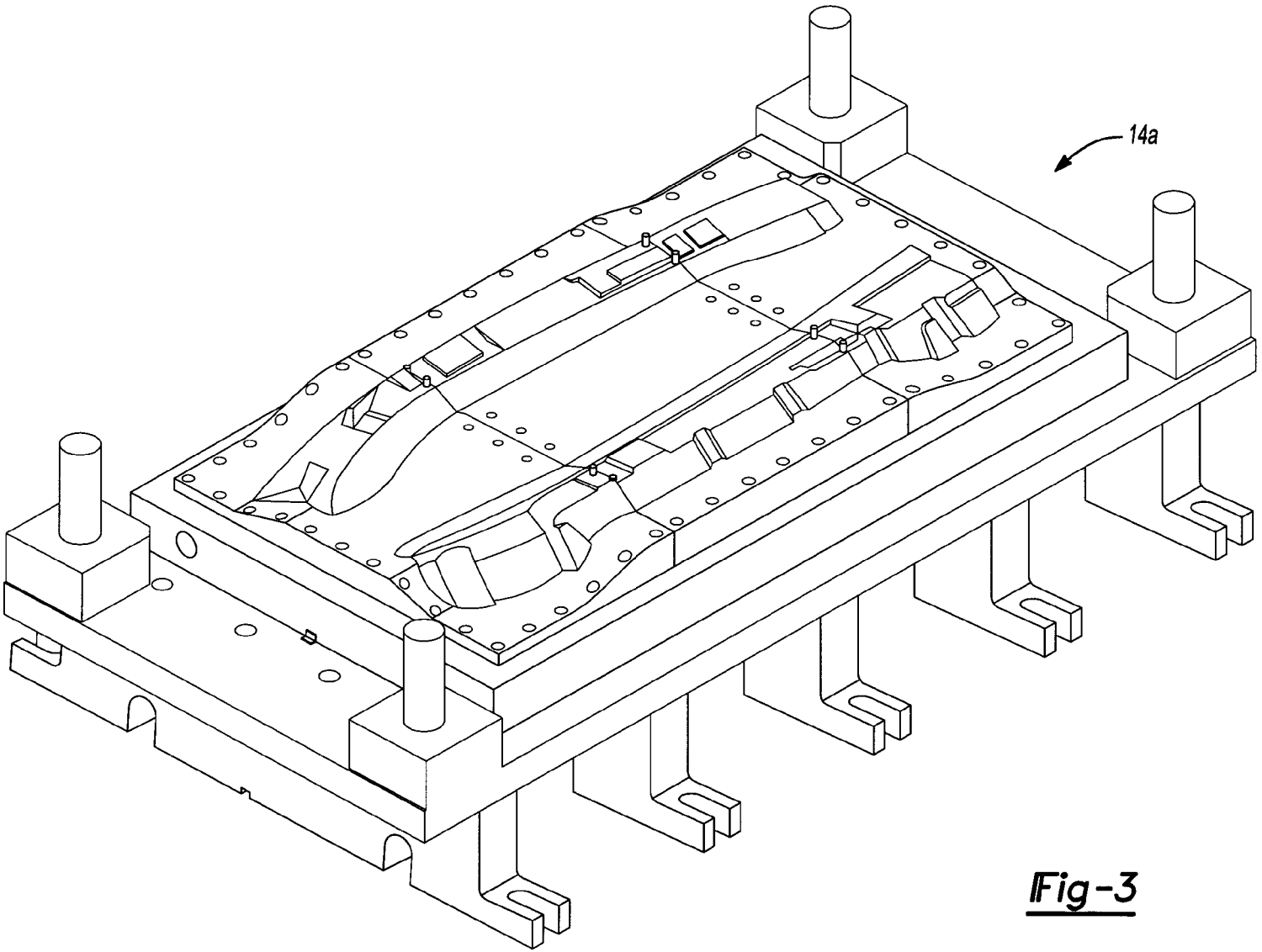
FIG. 3 is a perspective view of an upper die of the first exemplary hot forming die set.

With reference to FIGS. 2 and 3, a first exemplary hot forming die set is illustrated to include a lower die 12*a* and an upper die 14*a*. The upper die 14*a* can be formed in a substantially similar manner as the lower die 12*a* and as such, only the lower die 12*a* will be discussed in detail herein.

The lower die 12*a* can include a die base 100, a manifold base 102 and one or more die structures (e.g., die structures 104*a*, 104*b* and 104*c*) that can cooperate to form a die surface (e.g., die surfaces 20*a* and 20*a*'). The die base 100 is a platform or base that can perform one or more conventional and well known functions, such as providing a means for precisely mounting the remainder of the die, providing a means for mounting the die to a stamping press, and providing a means for guiding a mating die (i.e., the upper die 14) relative to the die when the die and the mating die are closed together. Except as noted otherwise herein, the die base 100 can be conventional in its construction and as such, need not be discussed in further detail herein.

Figure 4:
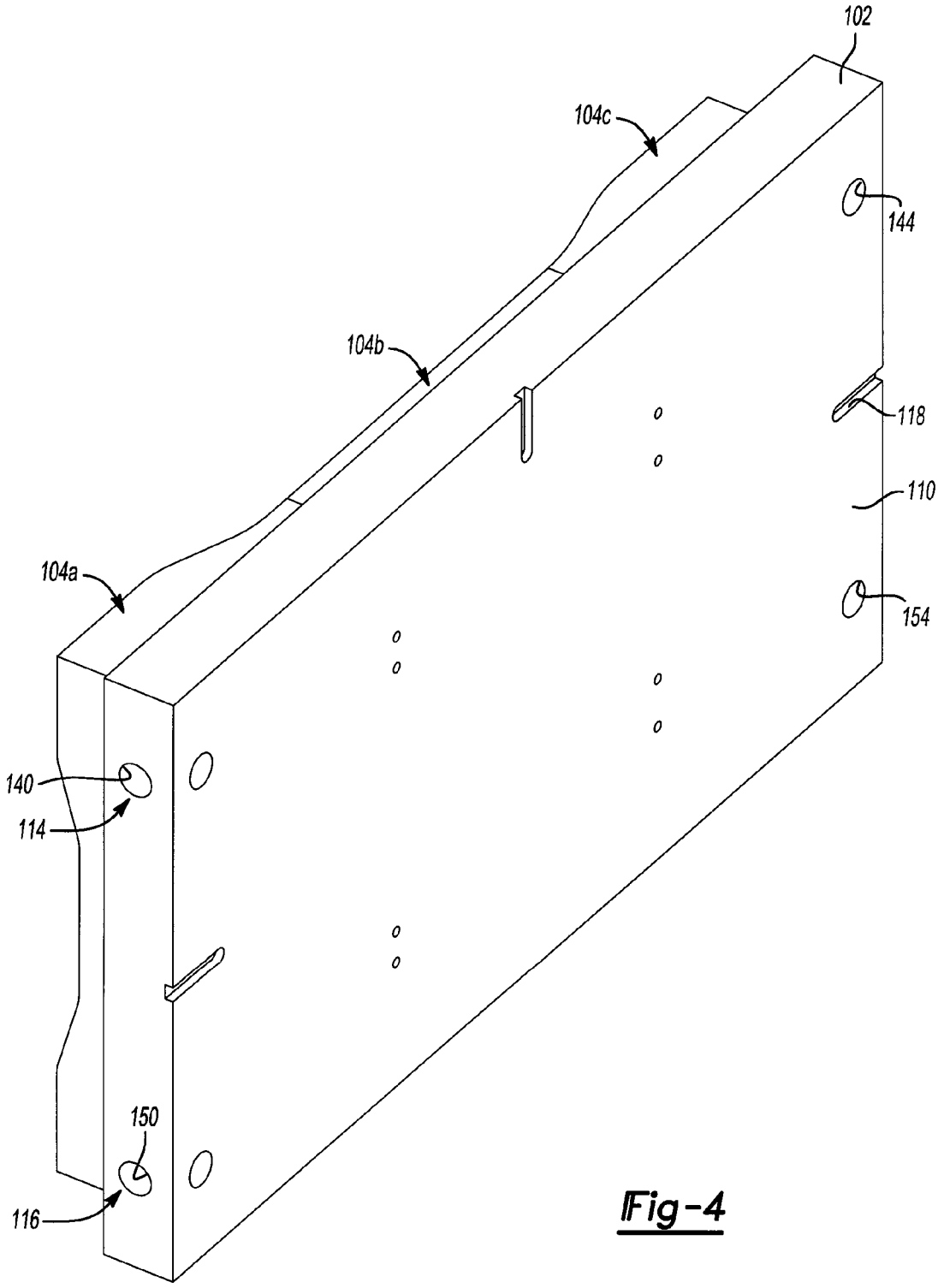
FIG. 4 is a bottom perspective view of a portion of the lower die of FIG. 2, illustrating the base manifold and the die structures in more detail.
Figure 5:
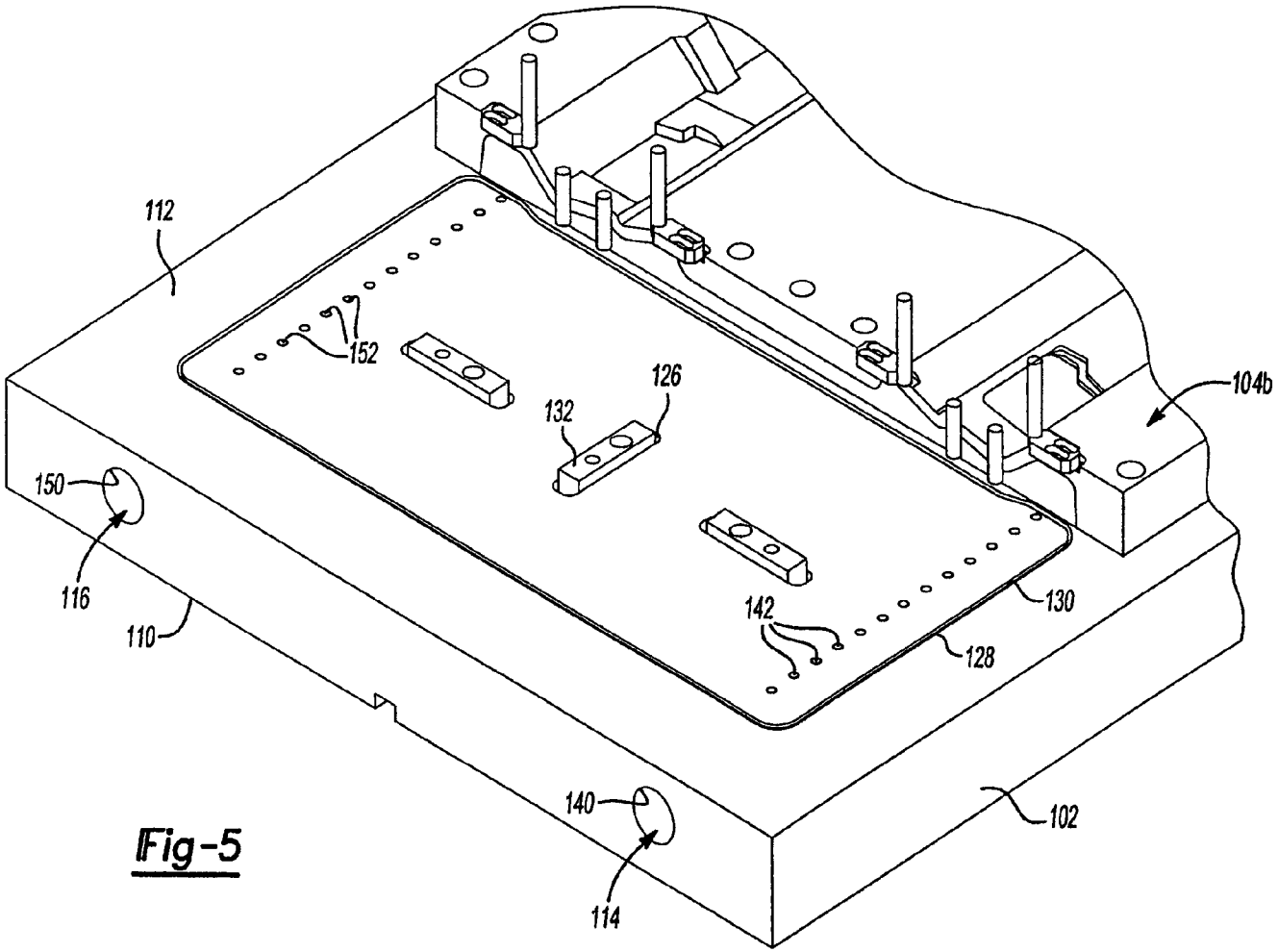
FIG. 5 is a top perspective view of a portion of the lower die of FIG. 2, illustrating the base manifold in more detail.

With reference to FIGS. 4 and 5, the manifold base 102 can be a slab-like member that is formed of an appropriate tool steel. The manifold base 102 can include a first mounting surface 110, a second mounting surface 112, an input manifold 114 and an output manifold 116. The first mounting surface 110 is configured to be mounted to the die base 100 (FIG. 2) and can include one or more positioning features, such as slots 118, that can be employed to locate the manifold base 102 relative to the die base 100 (FIG. 2). In the example provided, key members 120 (FIG. 2) are received into the slots 118 and engage mating slots 122 (FIG. 2) that are formed in an associated surface of the die base 100 (FIG. 2). The second mounting surface 112 can be opposite the first mounting surface 110 and can include one or more positioning features, such as slots 126, and one or more seal grooves 128 for receiving a seal member 130 that will be discussed in detail, below. The slots 126 can be employed to locate the die structure(s) (e.g., die structure 104*a*) to the manifold base 102. In the example provided, key members 132 are received in the slots 126 and engage corresponding slots (not shown) that are formed in the die structures 104*a*, 104*b* and 104*c*.

The input manifold 114 can comprise a relatively large diameter bore 140 that can extend longitudinally through the manifold base 102 on a first lateral side of the manifold base 102, and a plurality of input apertures 142 that can extend from the bore 140 through the second mounting surface 112. In the particular example provided, two supply apertures 144 are formed through the first mounting surface 110 and intersect the bore 140; the supply apertures 144 are configured to be coupled in fluid connection to the source of cooling fluid 38 (FIG. 1) to receive pressurized cooling fluid therefrom, and the opposite ends of the bore 140 can be plugged in a fluid-sealed manner (e.g., via pipe plugs). Accordingly, it will be appreciated that cooling fluid introduced to the supply apertures 144 will flow into the bore 140 and out through the input apertures 142.

The output manifold 116 can similarly comprise a relative large diameter bore 150, which can extend longitudinally through the manifold base 102 on a second, opposite lateral side of the manifold base 102, and a plurality of output apertures 152 that can extend from the bore 150 through the second mounting surface 112. In the particular example provided, two return apertures 154 are formed through the first mounting surface 110 and intersect the bore 150; the return apertures 154 are configured to be coupled in fluid connection to the source cooling fluid 38 (FIG. 1) to discharge cooling fluid to the reservoir (not shown) of the source of cooling fluid 38 (FIG. 1), and the opposite ends of the bore 150 can be plugged in a fluid-sealed manner (e.g., via pipe plugs). Accordingly, it will be appreciated that cooling fluid received into the bore 150 through the output apertures 152 will flow out of the manifold base 102 through the return apertures 154.

Returning to FIG. 2, the lower die 12*a* of the particular example provided employs three discrete die structures 104*a*, 104*b* and 104*c* that collectively form a pair of die surfaces 20*a* and 20*a*'. Three discrete structures have been employed in this example to permit portions of the lower die 12*a* to be replaced and/or serviced as needed. Construction of the lower die 12*a* in this manner can facilitate efficient and inexpensive maintenance of the die, but those of ordinary skill in the art will appreciate that the die may employ more or fewer die structures (e.g., a single die structure). The term "die surface" is employed herein to identify the portion(s) of the surface of a die (e.g., the lower die 12*a*) that form a portion of hot-stamped component 36 (FIG. 1). Accordingly, it will be appreciated from this disclosure that a "die surface" need not be coextensive with the associated outer surface of a die structure and that where two or more die surfaces are incorporated into a die structure constructed in accordance with the teachings of the present disclosure, a space 160, which does not form a portion of either of the die surfaces 20*a* and 20*a*', can be provided between the die surfaces 20*a* and 20*a*'.

Figure 6:
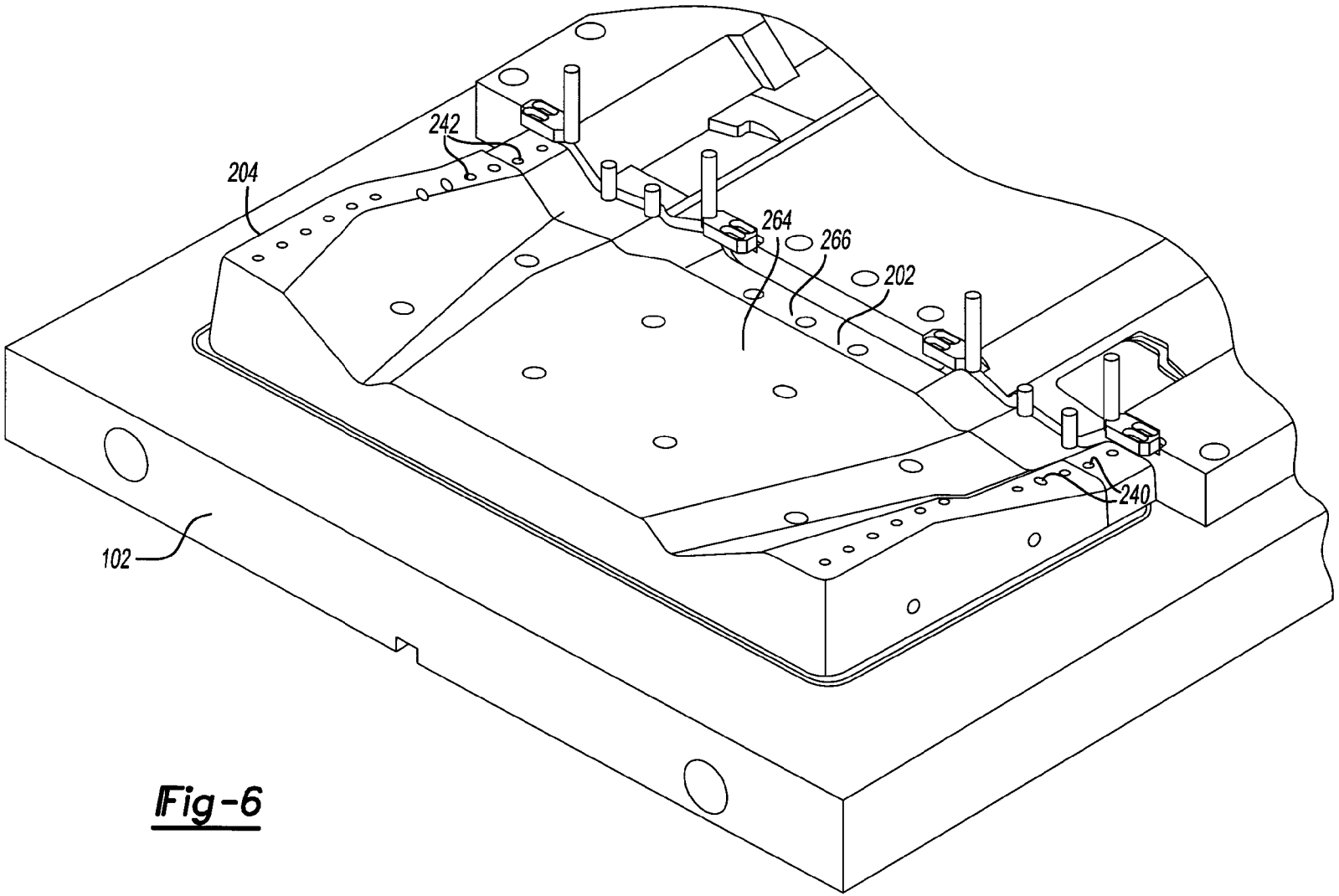
FIG. 6 is a top perspective view similar to that of FIG. 5 but illustrating portions of the die structure coupled to the base manifold.

With reference to FIGS. 2 and 6 though 8, the construction of the die structure 104*a* is illustrated. It will be appreciated that the construction of the remaining die structures 104*b* and 104*c* can be substantially similar and as such, the discussion of the construction of the die structure 104*a* will suffice for the discussion of the remaining die structures 104*b* and 104*c*. The die structure 104*a* can include a cap 200 (FIGS. 7 and 8), one or more end members or seam blocks 202 (FIGS. 6 and 7) and a cap insert 204 (FIGS. 6 and 8). The cap 200, the seam block(s) 202 and the cap insert 204 can cooperate to define a plurality of cooling channels 210 that can be coupled in fluid connection to the input apertures 142 and the output apertures 152.

Figure 7:
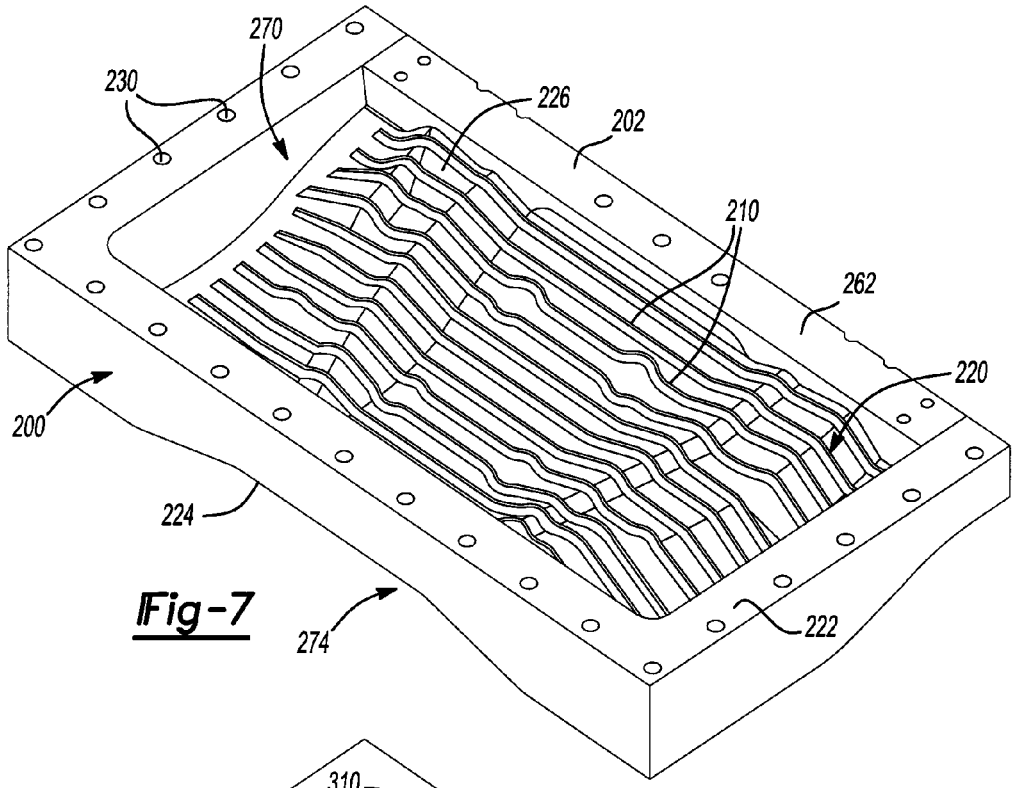
FIG. 7 is a bottom perspective view of a portion of the die structure illustrating a seam block as coupled to a cap.
Figure 8:
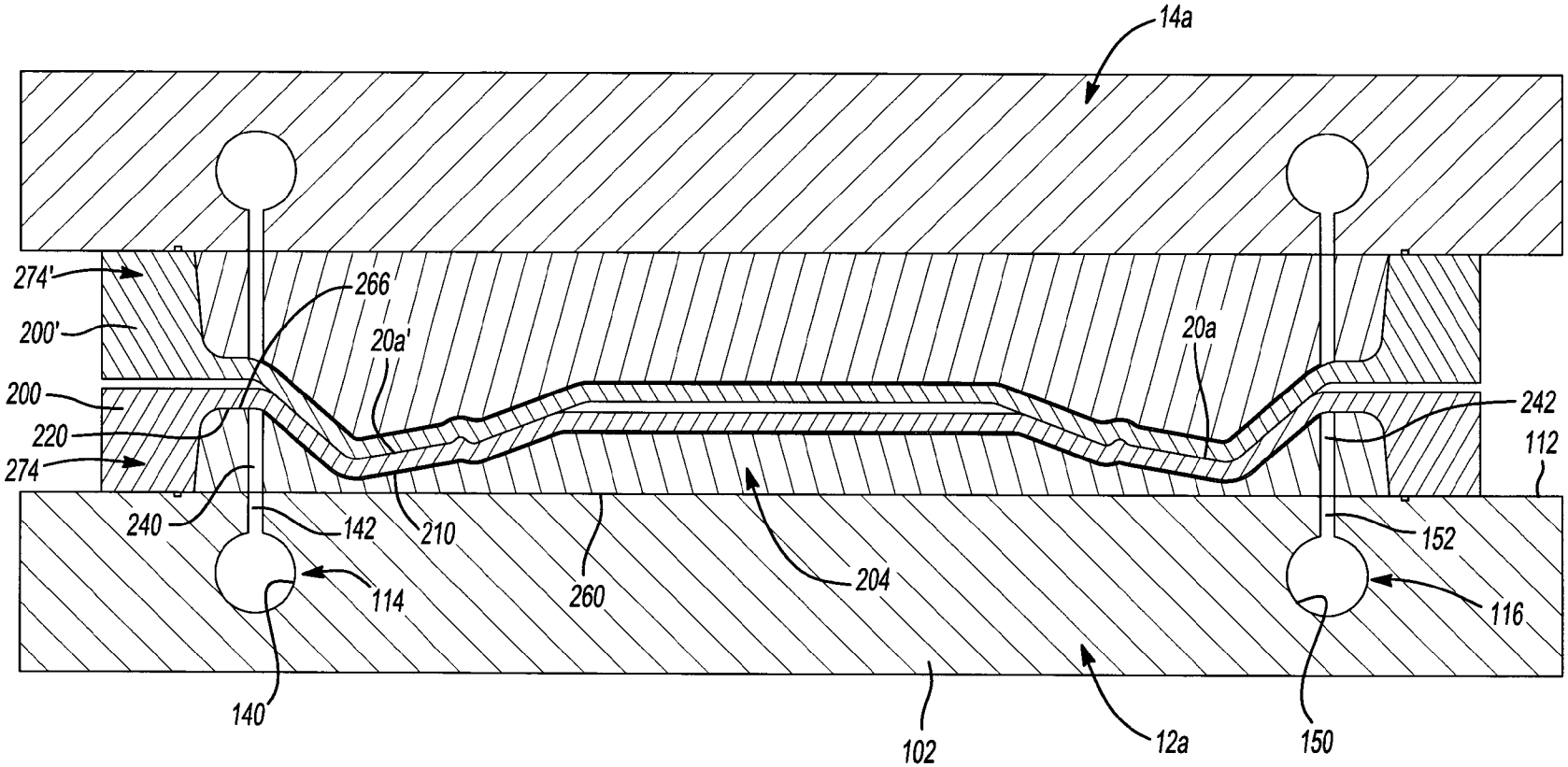
FIG. 8 is a portion of a sectional view taken laterally through the lower and upper dies of FIGS. 2 and 3 along a cooling channel.

With specific reference to FIGS. 7 and 8, the cap 200 can be formed of a tool steel, such as DIEVAR® or commercially available H-11 or H-13 and can be a shell-like structure that can include a cap wall 220 and a flange 222. The cap wall 220 includes an outer surface 224, which can define respective portions of the die surfaces 20*a* (FIG. 2) and 20*a*' (FIG. 2), and an inner surface 226 that can be spaced apart from the outer surface 224 by a desired amount. It will be appreciated that although the cap wall 220 has been illustrated as having a relatively uniform thickness, the thickness of any given portion of the cap wall 220 may be selected as appropriate. In the example provided, the flange 222 extends on three sides of the cap wall 220 as the die structure 104*a* (FIG. 2) is abutted against one other die structure (i.e., die structure 104*b* in FIG. 2). In contrast, the flange structure 220' (FIG. 2) of the die structure 104*b* (FIG. 2) abuts two die structures (i.e., die structures 104*a* and 104*c* in FIG. 2) and as such, extends only from the two opposite lateral sides of the die structure 104*b* (FIG. 2). Consequently, the die structure 104*b* (FIG. 2) employs two discrete seam blocks 202. The flange 222 can be configured to overlie an associated seal groove 128 that is formed in the manifold base 102 and can include a plurality of through-holes 230 that can be employed to fixedly but releasably secure the flange 222 to the manifold base 102 by threaded fasteners (not shown) that can be threadably engaged to threaded holes in the manifold base 102, for example.

With specific reference to FIGS. 6 through 8, the seam block 202 and the cap insert 204 are configured to support the cap wall 220 and as noted above, cooperate with the cap wall 220 to form a plurality of cooling channels 210 that can fluidly couple the input apertures 142 to the output apertures 152. The seam block 202 and the cap insert 204 include first and second apertures 240 and 242, respectively, that can be aligned to the input apertures 142 and the output apertures 152, respectively, to facilitate the flow of cooling fluid therethrough. It will be appreciated that in situations where a single die structure is employed to form the entire die surface, no seam blocks would be necessary (i.e., the flange 222 could extend completely around the cap wall 220 and the flange 222 could support the entire perimeter of the cap wall 220). In the example provided, however, the portion of the die surfaces 20*a* and 20*a*' defined by the die structure 104*a* (FIG. 2) extends to the unsupported edge 244 (FIG. 2) of the cap wall 220 (i.e., the portion of the cap wall 220 that is not supported by the flange 222) and consequently, this portion of the die surfaces 20*a* and 20*a*' (FIG. 2) must be both cooled in a controlled manner and supported. If the flange 222 were to be formed so as to extend in this area, the flange 222 would support the edge 244 of the cap wall 220 but would not permit the construction of cooling channels 210 in this area in accordance with the teachings of the present disclosure.

If the cap insert 204 were employed to support the edge 244 (FIG. 2) rather than a seam block 202, it would be desirable to couple the edge 244 to the cap insert 204. Threaded fasteners (not shown) could be employed to threadably engage blind threaded holes (not shown) formed in the cap wall 220 proximate the edge 244 in some situations, but the cap wall 220 may not be sufficiently thick in all situations to include blind threaded holes for receiving the threaded fasteners. Alternatively, the cap insert 204 could be substantially permanently coupled to the cap wall 220, as through welding. Construction in this manner may not be desirable in all instances as both the cap 200 and the cap insert 204 may need to be replaced when the cap 200 is sufficiently worn.

The cap insert 204, and where employed, the seam block(s) 202 can have first surfaces 260 and 262, respectively, which can be abutted against and fixedly secured to the second mounting surface 112 of the manifold base 102, and second surfaces 264 and 266, respectively, that can be abutted against the inner surface 226 of the cap wall 220. It is desirable that the second surfaces 264 and 266 of the cap insert 204 and the seam block(s) 202 closely match the contour of the interior surface 226 of the cap wall 220 and as such, it will typically be necessary "try out" and bench the inner surface 226 and/or the second surfaces 264 and 266 of the cap insert 204 and the seam block(s) 202 so that the surfaces conform to one another to a desired degree.

The cooling channels 210 can be formed in the inner surface 226, the second surface 264, the second surface 266 or combinations thereof. In the particular example provided, the cooling channels 210 are machined into the inner surface 226 of the cap wall 220 with a ball nose end mill (not shown). The cooling channels 210 can be machined such that they are disposed a predetermined distance from the die surfaces 20*a* and 20*a*'. In this regard, it will be appreciated that each cooling channel 210 has a contour (when the cooling channel 210 is viewed in a longitudinal section view) and that the contour of each cooling channel 210 is generally matched to the contour of the die surface (i.e., the die surface 20*a* or 20*a*') at locations that are directly in-line with the cooling channel 210 (when the cooling channel 210 is viewed in a longitudinal section view). For purposes of this disclosure and the appended claims, the contour of a cooling channel 210 matches the contour of a die surface if deviations between the smallest distance between the cooling channel 210 and the die surface for each relevant point of the cooling channel 210 (i.e., each point that is directly in-line with a die surface when the cooling channel 210 is viewed in a longitudinal section view) are within about 0.15 inch and preferably, within about 0.04 inch.

With the cooling channels 210 formed (e.g., in the inner surface 226 of the cap wall 220 in this example), the seam block 202 can be coupled to the cap 200 to support the edge 244. In the particular example provided, the seam block 202 overlies two of the cooling channels 210 that are formed proximate the edge 244. The seam block 202 can be welded to the cap 200 (i.e., to the cap wall 220 and the flange 222) to fixedly couple the two components together. In the particular example provided, the weld forms a seal that prevents the cooling fluid that is introduced to the two cooling channels 210 proximate the edge 244 from infiltrating through the interface between the seam block 202 and the cap 200. Those of ordinary skill in the art will appreciate that the seam block 202 forms the "missing portion" of the flange 222 and the assembly of the cap 200 and seam block 202 forms a cavity 270 into which the cap insert 204 can be received.

The cap insert 204 can be fixedly but removably coupled to the second mounting surface 112 of the manifold base 102 in any appropriate manner. In the example provided, locators, such as slots and keys (not specifically shown) are employed to position the cap insert 204 in a desired position relative to the manifold base 102 and threaded fasteners (not specifically shown) can extend through the cap insert 204 and threadably engage corresponding threaded apertures (not specifically shown) in the manifold base 102. The assembly 274 of the cap 200 and the seam block 202 can be fitted over the cap insert 204, which can position the portion of the die surfaces 20*a* and 20*a*' in a desired location relative to the manifold base 102 due to the prior positioning of the cap insert 204 and the conformance between the inner surface 226 and the second surface 264. Threaded fasteners (not specifically shown) can extend through the assembly 274 (i.e., through the flange 222, and the seam block 202 and the cap wall 220) and can threadably engage threaded apertures (not specifically shown) that are formed in the manifold base 102. It will be appreciated that a seal member 130, such as an O-ring, can be received in the seal groove 128 and that the seal member 130 can sealingly engage the manifold base 102, the flange 222 and the seam block 202.

In operation, pressurized fluid, preferably water, from the source of cooling fluid 38 (FIG. 1) is input to the input manifold 114, flows out the input apertures 142 in the manifold base 102, through the first apertures 240 in the cap insert 204 and seam block 202, through the cooling apertures 210, through the second apertures 242 in the cap insert 204 and the seam block 202 and through the output manifold 116 to the reservoir (not shown) of the source of cooling fluid 38 (FIG. 1). In one form, the cooling fluid is cycled in a continuous, uninterrupted manner, but it will be appreciated that the flow of cooling fluid can be controlled in a desired manner to further control the cooling of the die surfaces 20*a* and 20*a*'.

The source of cooling fluid 38 (FIG. 1) and the design, placement and construction of the cooling channels 210 permit the lower and upper dies 12*a* and 14*a* to be cooled to an extent where they can quench the hot stamped component 36 (FIG. 1) relatively quickly, even when the hot forming die set 10*a* (FIG. 2) is employed in volume production. Accordingly, a hot forming die set 10*a* can be employed to form, quench and cool the hot-stamped components (workpieces) at volumes such as 120 or 180 pieces per hour and achieve an austenite-to-martensite phase transformation over the entirety of the workpiece. The austenite-to-martensite phase transformation may be achieved within about 4 seconds or less of the closing of the lower and upper dies 12*a* and 14*a*. Significantly, the hot-stamped components 36 (FIG. 1) can be quenched and optionally cooled such that it is free of significant amounts of pearlite and bainite when it is removed from the hot-forming die set 10*a* (FIG. 2).

Those of ordinary skill in the art will appreciate that the cap 200 is heat treated in an appropriate heat-treating operation to harden the die surfaces 20*a* and 20*a*' to a desired hardness. Those of ordinary skill in the art will also appreciate that the particular construction of the cap 200 is susceptible to distortion during the heat treating operation. We have noted in our experiments that distortion can be controlled by coupling the cap assembly 274' of the upper die 14*a* with the cap assembly 274 of the lower die 12*a* and heat treating the coupled cap assemblies 274, 274' together. More specifically, the cap 200 of a lower die 12*a* is assembled to its associated seam block(s) 202, if any, and the associated cap 200' of a corresponding upper die 14*a* is assembled to its associated seam block(s) 202, if any. The assembly 274 (i.e., the cap and seam blocks) of the lower die 12*a* is coupled to the assembly 274' (i.e., the cap and seam blocks) of the upper die 14*a* to form a hollow structure having a rim, which is formed by the abutting flanges and seam blocks. In our experiments, we coupled the assemblies 274, 274' to one another via tack welds located at the interface of the abutting flanges and the interface of the abutting seam blocks. We removed the tack welds following the heat treat operation and observed significantly less distortion of each assembly as compared to assemblies that had been separately heat treated.

Figure 9:
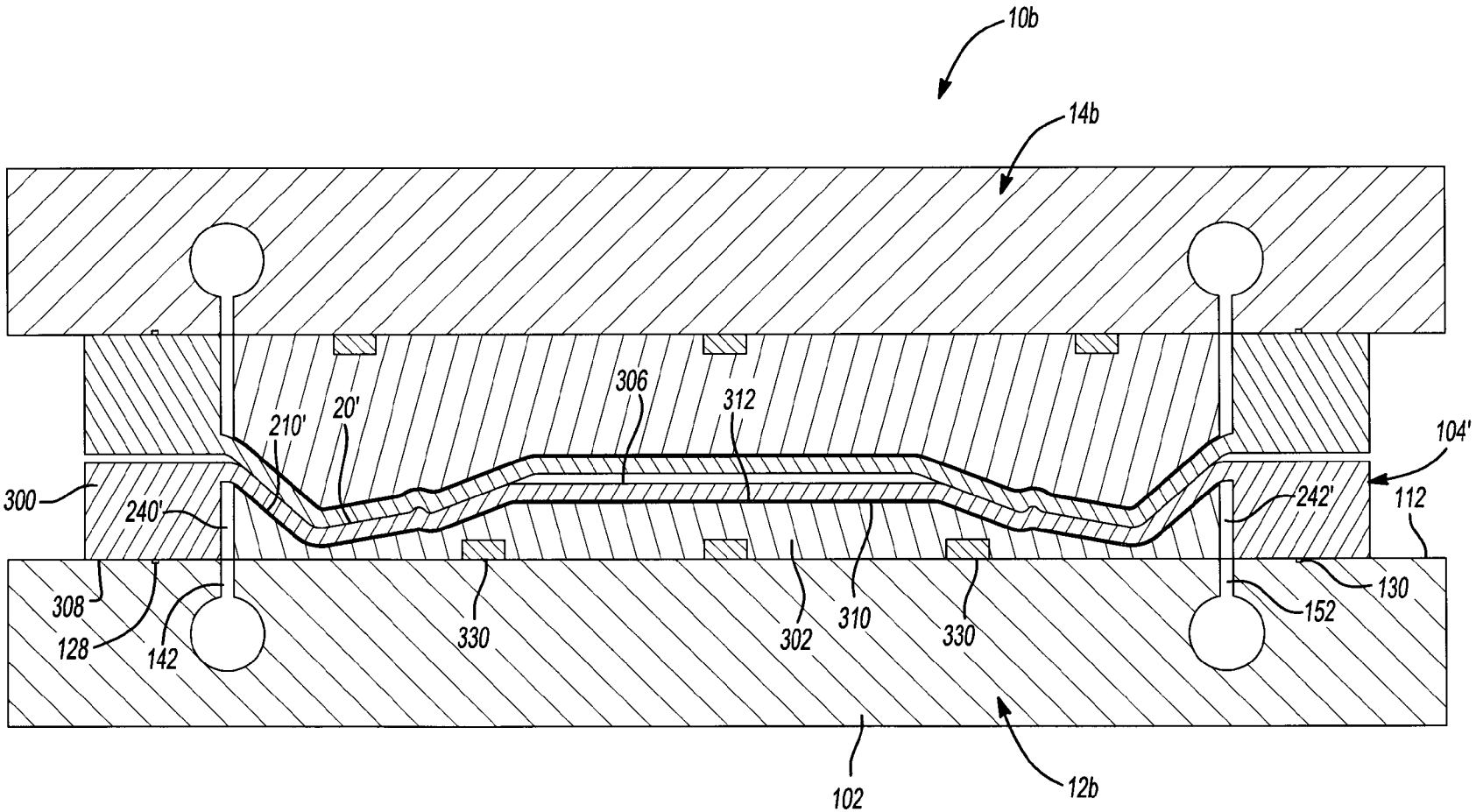
FIG. 9 is a view similar to that of FIG. 8 but illustrating a second exemplary hot forming die set constructed in accordance with the teachings of the present disclosure.

With reference to FIG. 9, a second exemplary hot forming die set 10*b* is partially illustrated to include a lower die 12*b* and an upper die 14*b*. The upper die 14*b* can be formed in a substantially similar manner as that of the lower die 12*b* and as such, only the lower die 12*b* will be discussed in detail herein.

Figure 10:
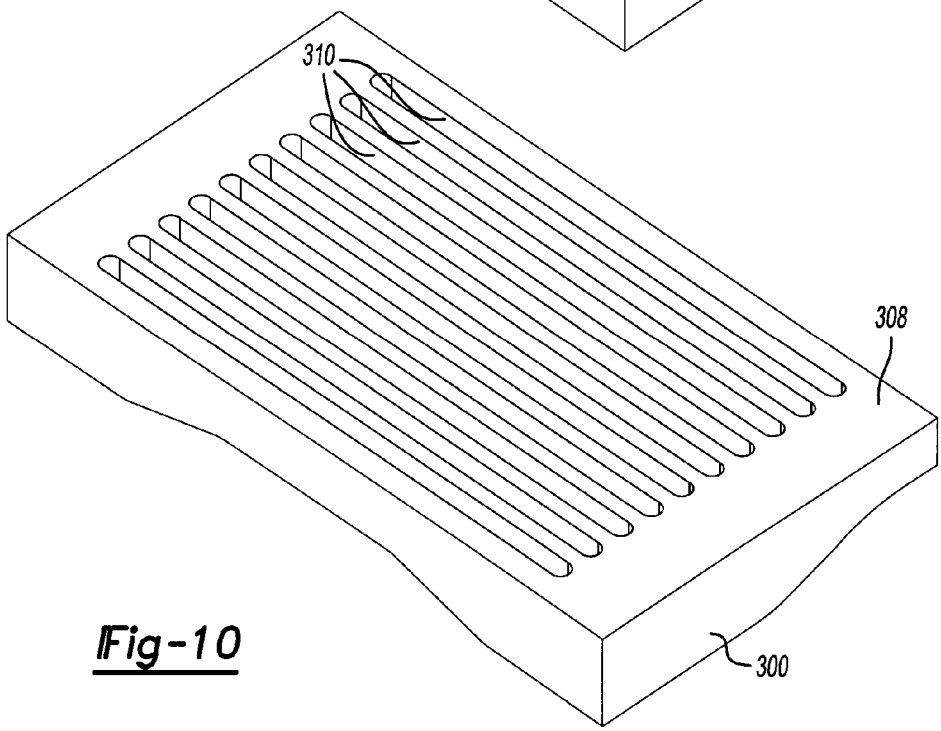
FIG. 10 is a bottom perspective view of a portion of the hot forming die set of FIG. 9 illustrating the grooves as formed in a surface of the die member.

The lower die 12*b* can include a die base (not shown), a manifold base 102 and one or more die structures 104'. The die base and the manifold base 102 can be substantially identical to those which are described above. Each die structure 104' can include a die member 300 and a plurality of filler plates 302 (only one of which is shown). The die member 300 can have an outer surface 306, which can at least partially define at least one die surface 20', and an inner surface 308 that can be abutted against the second mounting side 112 of the manifold base 102. With additional reference to FIG. 10, cooling slots or grooves 310 can be formed into the inner surface 308 (e.g., with a ball nose end mill) such that the interior end 312 of the groove 310 is generally matched to the contour of the die surface 20' when the groove 310 is viewed in a longitudinal section view. The filler plates 302 can be formed of any appropriate material and can be formed to fill a portion of an associated groove 310 such that the unfilled portion of the groove 310 can define a cooling channel 210'. In this example, the cooling channel 210' includes input and output ports 240' and 242', respectively, that are directly coupled to the input and output apertures 142 and 152 that are formed in the manifold base 102.

The filler plates 302 can be formed in any desired manner, such as wire electro-discharge machining (wire EDM'ing). The thickness of the filler plates 302 can be selected to closely match a width of the grooves 310, but it be appreciated that the filler plates 302 can be received into the grooves 310 in a slip-fit manner. The filler plates 302 may be retained in the grooves 310 in any desired manner. In one form, the filler plates 302 can be tack welded to the die member 300, but in the example provided, one or more retaining bars 330 can be secured to the die member 300 to inhibit the withdrawal of the filler plates 302 from the grooves 310.

The die structure 310 can be coupled to the manifold base 102 in a manner that is substantially similar to that which is described above for the coupling of the cap assembly (i.e., the cap 200 and the seam block 202) to the manifold base 102. In this regard, threaded fasteners (not shown) can be employed to secure the die member 300 to the manifold base 102 and a seal member 130 can be employed to inhibit infiltration of cooling fluid through the interface between the manifold base 102 and the die member 300.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. A method comprising: providing a first die having a first die structure; forming a first die surface on the first die structure, the first die surface having a complex shape; forming a plurality of cooling channels in the first die structure, each of the cooling channels having a contour that generally follows the complex shape of the first die surface; and forming a second die with a second die surface, the first and second die surfaces cooperating to form a die cavity, and wherein the first die structure includes a first die member and wherein forming the plurality of cooling channels comprises: forming a plurality of slots in a surface of the first die member opposite the first die surface; forming a plurality of filler plates; and inserting each filler plate to an associated one of the slots, each filler plate cooperating with the associated one of the slots to form an inlet port and an outlet port.

2. The method of claim 1, further comprising: providing a base having a cooling fluid inlet and a cooling fluid outlet; securing the first die member to the base such that the cooling fluid inlet is coupled in fluid connection to the inlet ports; and providing a flow of cooling fluid to the base, the cooling fluid entering the cooling channels from the inlet ports and exiting the cooling channels from the outlet ports.

3. The method of claim 1, wherein the first die structure includes a first member and a second member, the first member forming a first shell into which the second member is at least partially disposed.

4. The method of claim 3, wherein the first die structure includes an end member that is fixedly coupled to an associated end of the first member, the end member cooperating with the second member to fill the first shell.

5. The method of claim 4, wherein at least one cooling channel is formed between the first member and the end member.

6. The method of claim 5, wherein the second die surface is formed on a second die structure, and wherein the second die structure includes a first member and a second member, the first member of the second die structure forming a second shell into which the second member of the second die structure is at least partially disposed.

7. The method of claim 6, further comprising: coupling at least a portion of the first shell to at least a portion of the second shell to form a shell assembly; and heat treating the shell assembly.

8. The method of claim 7, wherein the at least the portion of the first shell is welded to the at least the portion of the second shell.

9. A hot forming die comprising: a first die having a first die structure that is formed of a tool steel, the first die structure having a first die surface and a plurality of first cooling apertures, the first die surface having a complex shape, the first cooling apertures being spaced apart from the die surface by a first predetermined distance; and a second die having a second die surface, the first and second die surfaces cooperating to form a die cavity, and wherein the first die structure includes a die member and a plurality of filler plates, the die member defining a plurality of slots in a surface of the first die structure opposite the first die surface, each filler plate being received into an associated slot and cooperating with the slot to form an associated one of the first cooling apertures.

10. The hot forming die of claim 9, wherein the second die has a plurality of second cooling apertures being spaced apart from the second die surface by a second predetermined distance.

11. The hot forming die of claim 9, wherein the first die structure includes a first member and a second member, the first member defining a first shell, the second member being at least partially received into the shell and cooperating with the first member to define at least a portion of the first cooling apertures.

12. The hot forming die of claim 9, wherein the first die structure further includes an end member, the end member cooperating with the first member to define another portion of the first cooling apertures, the end member being fixedly coupled to an end of the first member.

13. A method of hot forming a workpiece comprising: providing a die with an upper die and a lower die, each of the upper and lower dies including a die structure that defines a die surface and a plurality of cooling channels, the die surface having a complex shape, the cooling channels being spaced apart from the die surface in a manner that generally matches a contour of the die surface and a plurality of slots in fluid communication with the cooling channels and wherein said slots are at least partially defined as a surface of at least one of the upper and lower dies, in a surface opposite the die surface of the at least one of the upper and lower dies, the die surfaces cooperating to form a die cavity; heating a steel sheet blank; placing the heated steel sheet blank between the upper and lower dies; closing the upper and lower dies to form the workpiece in the cavity; cooling the die structures of the upper and lower dies to quench the workpiece in the cavity; and ejecting the quenched workpiece from the cavity.

* * * * *